US005163674A

United States Patent [19]

Parks

[11] Patent Number: 5,163,674

[45] Date of Patent: Nov. 17, 1992

[54] DRIVE MEANS FOR A RECORDING MEDIUM HAVING LIQUID IMAGES THEREON

[75] Inventor: Bruce J. Parks, Fairport, N.Y.

[73] Assignee: Xerox Corporation, Stamford, Conn.

[21] Appl. No.: 766,296

[22] Filed: Sep. 27, 1991

[51] Int. Cl.[5] ..... B65H 5/02

[52] U.S. Cl. ..... 271/274; 271/314; 101/416.1

[58] Field of Search ..... 101/416.1, 420, 421, 101/422; 29/121.1, 121.4, 121.5, 121.6; 226/181, 182, 184, 186; 271/272, 273, 274, 109, 119, 314

[56] References Cited

U.S. PATENT DOCUMENTS

| | | | |
|---|---|---|---|
| 685,370 | 10/1901 | Bridgewater | 271/119 |
| 3,484,099 | 12/1969 | Gallagher | 271/274 |
| 3,952,183 | 4/1976 | Abe | 235/92 SB |
| 4,060,238 | 11/1977 | Simeth | 101/422 |
| 4,212,555 | 7/1980 | Rosenstock | 101/416.1 |
| 4,511,135 | 4/1985 | Huerta et al. | 271/126 |
| 4,687,192 | 8/1987 | Hunt | 271/119 |
| 4,715,593 | 12/1987 | Godlewski | 271/10 |

*Primary Examiner*—H. Grant Skaggs
*Attorney, Agent, or Firm*—Robert A. Chittum

[57] ABSTRACT

In the present invention, a drive means for use in a printer or copier is described which will transport a recording medium, such as paper, having liquid images on one surface thereof without inadvertently causing the recording liquid to be pushed from the still wet image areas into non-image areas, thereby reducing print quality. This transportation of a recording medium with wet images without degradation of print quality is accomplished by a drive means comprising a drive roller having a high friction surface which is rotatably mounted beneath and tangent to a planar path of movement for the recording medium and a toothed idler roller having spaced teeth with rounded distal ends which extend from a hub to form a nip with the drive roller through which the recording medium is transported. The teeth have a predetermined height from the hub and a predetermined spacing between teeth. The distal ends of the teeth have a surface which is of a material that is not wetted by a recording liquid.

15 Claims, 5 Drawing Sheets

DRIVE MEANS FOR A RECORDING MEDIUM HAVING LIQUID IMAGES THEREON

BACKGROUND OF THE INVENTION

This invention relates generally to sheet feeding mechanisms and more particularly to drive means for transporting sheets having wet images thereon comprising drive rollers which do not disturb the wet images by pushing or squeezing the recording liquid into non-image areas thus avoiding print defects.

In prior art sheet handling devices, shingling apparatus, envelope feeders, and the like, friction rollers having high surface friction characteristics relative to the friction between sheets to be separated are generally employed. For one prior art example of a bottom document feeder, a stack of documents are lowered onto a conveyer which strips the bottom document therefrom and positions it to a metering device for individual withdrawal. The metering device has a retard cylinder and an opposing lower feed roller defining an intake nip for grasping the document delivered thereto by the conveyor. The feed roller has a longer traverse than the conveyor so as to enable complete withdrawal of the document from the stack. For increased friction, it is well known to use ribbed feed rollers in such arrangements. In top document feeders, a high friction feed roller is periodically lowered into contact with the top document of a stack of documents and, in cooperation with a retard pad or retard roller, forwards only the top document from the stack. Shingling apparatus for separating and feeding sheets have been in existence for some time, and many of them use rollers which have ribs or flutes generally to provide increased friction. However, none of the prior art sheet transports solve the problem of driving a recording medium containing liquid images which have not dried without the rollers generating a wave front immediately in front of the roller-to-sheet interface and causing the recording liquid to be pushed or squeezed into non-image areas, thus producing print defects.

U.S. Pat. No. 685,370 to Bridgewater discloses a paper feeding pressure roller which may be solid or hollow for more resilience, formed from rubber, and have a serrated periphery. The serrations are in the form of sharply defined teeth, each having two faces of different angular acuteness, so that the teeth point in the direction of rotation.

U.S. Pat. No. 4,715,593 to Godlewski discloses a stack supporting bottom feed mechanism which provides a novel conveying system for bottom feeding from a stack of items and employs the use of a series of aggressive and nonaggressive rollers. The series of aggressive toothed rollers are driven to rotate half turns and the series of nonaggressive smooth rollers are adapted to lift the stack and provide slide areas for easy removal of an item from the bottom of the stack. This system provides an efficient means to singularly bottom feed paper into a printer or the like.

U.S. Pat. No. 4,687,192 to Hunt discloses a sheet feed apparatus which employs a rotable feed wheel used to shingle a stack of paper. The rotable feed wheel is unitarily constructed and its surface which contacts the sheets of paper is toothed so that it produces a lower coefficient of friction between the wheel protrusions and the outermost sheet of paper being shingled than the coefficient of friction between the outermost sheet and its adjacent sheet in the stack.

U.S. Pat. No. 4,511,135 to Huerta et al. discloses a method and apparatus for feeding envelopes singularly and smoothly into a high speed printer or the like. The envelopes are urged forward using a pressure plate angled at 125 degrees in order to present them to a picking station. The frontmost envelopes are shingled using a ferris wheel type roll wave picker separator. After proper alignment of serrated rollers, the envelopes are accurately fed into a print station. The serrated rollers along with the idler rollers enhance the concavity of the foremost envelope in the stack when it is being shingled forward.

U.S. Pat. No. 3,952,183 to Abe discloses a method and apparatus for counting sheets arranged in a stack. An infeed mechanism comprises first and second rollers which frictionally feed the sheets one by one into the apparatus. Toothed rollers called "star wheels" are positioned on the conveyor belts so that their teeth will engage in the trailing end of each sheet that has been transported into a holder plate. The toothed surface of the star wheel affords sufficient friction between itself and the sheet of paper so that the sheets are fed singularly into the counting mechanism.

SUMMARY OF THE INVENTION

It is an object of the present invention to use a toothed roller having troughs located between the roller teeth which are deep enough to prevent the recording liquid of the wet printed images on the surface of a recording medium from touching the troughs as the teeth track therethrough, thereby preventing the possibility of pushing the recording liquid forming the liquid image areas into the non-image areas as the teeth step into and out of the wet image areas.

It is another object of the invention to use a toothed roller having spaced teeth with rounded distal ends which extend from the hub of the roller a predetermined distance, the teeth having a predetermined geometry and spacing and a surface which is of a hydrophobic material that is not wetted by the water based recording liquid, so that the tendency of recording liquid to attach itself to the teeth is minimized, while concurrently preventing the possibility of pushing the recording liquid out of the image areas and into non-image areas as the teeth step into and out of the wet image areas.

In the present invention, a recording medium drive means for use in a printer or copier is described which will transport a recording medium, such as paper, having liquid images on one surface thereof without inadvertently causing the recording liquid, such as ink or liquid developer, to be pushed from the still wet image areas into non-image areas, thereby reducing print quality. This transportation of a recording medium with wet images without degradation of print quality is accomplished by a drive means comprising a drive roller having a high friction surface and an axis of rotation which is rotatably mounted beneath and tangent to a planar path of movement for the recording medium. The drive roller is oriented to move the recording medium along the path of movement and is driven by any suitable means, such as, for example, an electric motor. A toothed idler roller having an axis of rotation and spaced teeth with rounded distal ends which extend from a hub forms a nip with the drive roller through which the recording medium is transported. The teeth have a predetermined height from the hub and a predetermined spacing between teeth. The distal ends of the teeth have a surface which is of a hydrophobic material that is not wetted by the water based recording liquid. The idler roller is rotatably mounted above the recording medium planar path of movement with the idler roller axis being parallel to the axis of the drive roller. A means is provided for urging the idler roller teeth into contact with the surface of the drive roller to form the driving nip by either gravity or spring, so that the idler teeth apply a predetermined force that is substantially normal to the drive roller surface. When a recording medium is moved along the path of movement with the image-free surface or backside in a direction to be contacted and driven by the drive roller, the idler roller teeth place a normal force on the recording medium surface containing liquid images and the length and geometry of the teeth enable them to step into and out of the wet images during idler roller rotation without forcing recording liquid out of the image areas into the non-image background regions. Though the idler roller teeth have a surface material which is not wetted by the recording liquid, a cleaning roller is rotatably mounted for contact with the distal ends of the idler roller teeth to ensure that they remain free of recording liquid and other contamination, such as dust and paper fibers. Various embodiments of the idler roller are disclosed such as the teeth having a helical design and, instead a plurality of single wide teeth spaced around the periphery of a cylindrical hub, rows of small cylindrical teeth are spaced around the idler roller hub.

BRIEF DESCRIPTION OF THE DRAWINGS

The present invention will be described by way of example with the accompanying drawings wherein like parts have like reference numerals, and wherein.

DESCRIPTION OF THE PREFERRED EMBODIMENT

Figure 1:
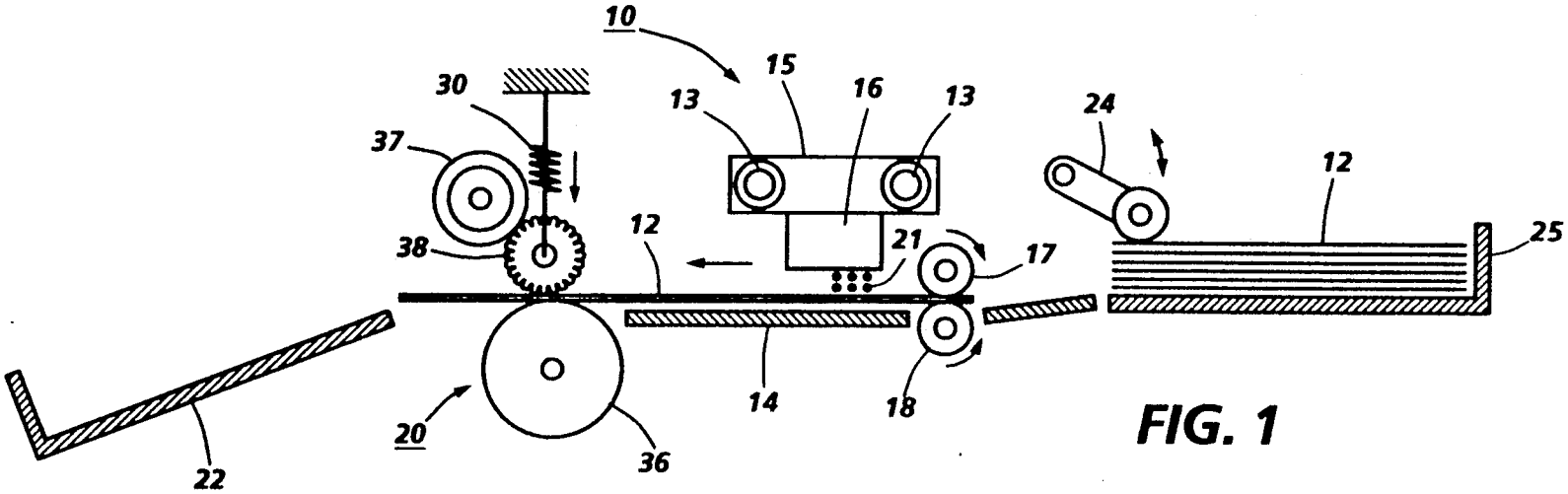
FIG. 1 is a schematic side elevation view of an ink jet printer showing the recording medium drive means of the present invention.

Although the liquid images discussed herein may be printed directly on a recording medium, such as paper, by an ink jet printer or transferred thereto by a liquid development process in either an electrographic reproducing machine or an electrophotographic copier or laser printer, the description of the present invention will be described in the environment of an ink jet printer, such as that shown in FIG. 1, showing a schematic representation of a thermal ink jet printer 10 in a side elevation view. The ink jet printer 10 may employ a typical translating thermal ink jet printhead 16 mounted on a carriage 15 which travels back and forth across the recording medium on guide rails 13 or may employ a fixed pagewidth printhead (not shown), wherein the recording medium is continually moved therepast at a constant velocity by feed rollers (not shown). The printhead 16 ejects ink droplets 21 onto the recording medium 12 residing on printing platen 14 one swath at a time and feed rollers 17 and 18, one of which is driven by a motor capable of precise motion quality (not shown), are used to register and step the recording medium 12 past the printhead after each swath is printed until the entire surface area of the recording medium is printed, at which time the drive means 20 of the present invention, described later, is used to forward the recording medium with wet images forward to a catch tray 22. If the images on the recording medium have not dried by the time they are stacked in the catch tray and before the next recording medium is stacked thereon, then an optional dryer (not shown) may be used prior to entry of the recording medium into the catch tray. A typical document feeder 24 moves single sheets of recording medium on demand to the feed rollers 17, 18 from a cassette or paper supply 25. For a more detailed description of the printhead refer to U.S. Pat. Nos. 4,774,530 and 4,571,599 incorporated herein by reference. A printer controller (not shown) causes the timely delivery of a recording medium 12 to the printing platen 14 and the printhead 16 to print the required information on it. Before the trailing edge of recording medium exits from the feed rollers 17, 18, the drive means 20 has received the leading edge of it, while the ink or recording liquid images formed on the surface of the recording medium confronting the printhead is still wet.

Figure 2B:
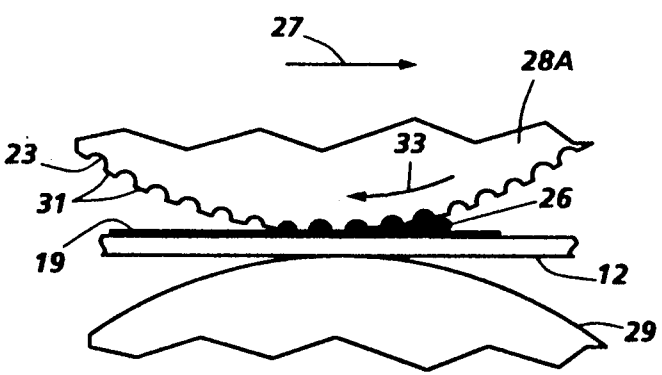
FIG. 2B Prior Art
FIG. 2B is an enlarged, schematic side view of a recording medium containing a wet image in the nip of a prior art pair of drive rollers having an idler roller with the typical ribbed or fluted surface.
Figure 2A:
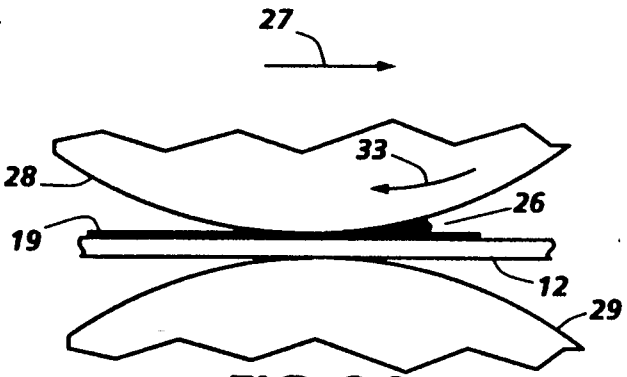
FIG. 2A Prior Art
FIG. 2A is an enlarged, schematic side view of a recording medium containing a wet image in the nip of a prior art pair of drive rollers having an idler roller with a solid cylindrical surface.

Referring FIGS. 2A and 2B, a typical pair of transport rollers 28, 29 are shown in which the roller 28, either idler or driven, contacting the wet image 19 on recording medium 12 forces a wave 26 of recording liquid forward thereof in the direction of relative movement depicted by arrow 27 as the roller rotates in the direction of arrow 33. Note that roller 28A in FIG. 2B causes a wave of liquid ink or recording liquid even though it has ribs or teeth-like projections 31 because the troughs 23 between the projections are not deep enough to prevent the recording liquid from contacting and/or filling them. Thus, the problem of transporting documents with wet images without inadvertently forcing the recording liquid from the image areas to non-image or background areas was not recognized or solved by the prior art document handling rollers.

Figure 3:
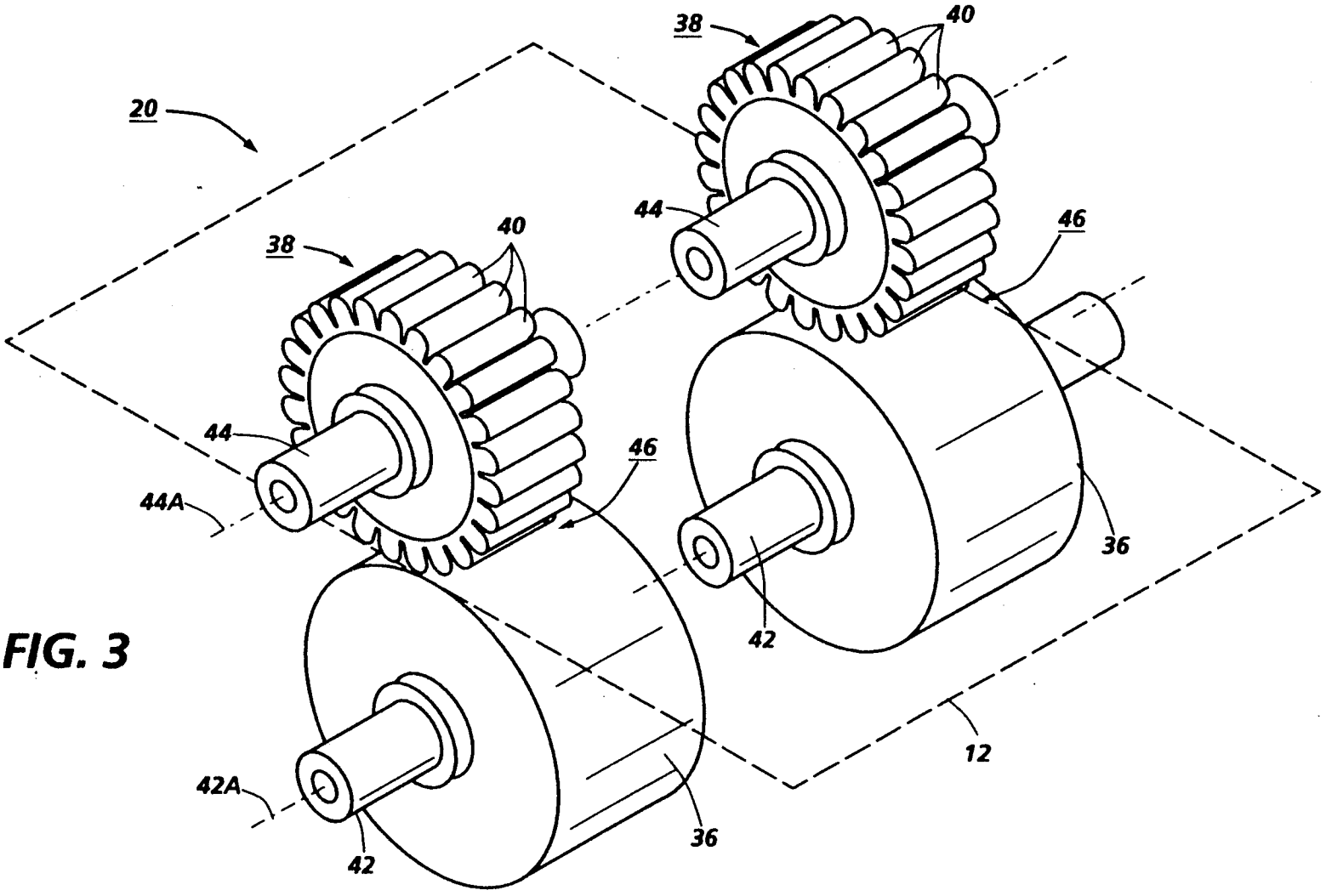
FIG. 3 is a partially shown, isometric view of the drive means of the present invention.
Figure 4:
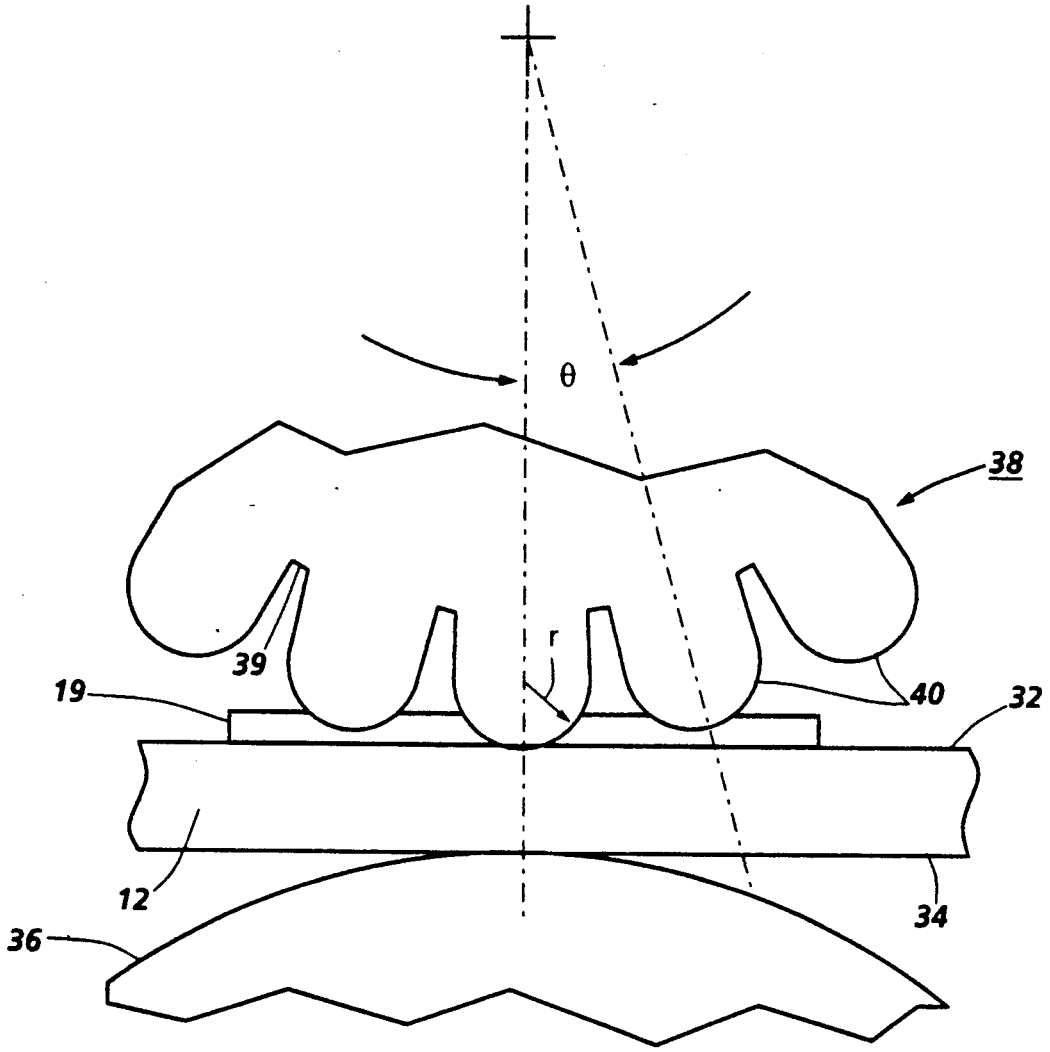
FIG. 4 is an enlarged side view of a portion of the toothed idler roller of the drive means shown in FIGS. 1 and 3.

In FIGS. 3 and 4, the drive means 20 of the present invention is shown comprising drive roller 36 and idler roller 38. The drive roller has a high friction surface which contacts the bottom side or non-image side 34 of the recording medium 12 and provides the transporting force for the recording medium. The drive roller has a larger diameter than the idler roller, and, in the preferred embodiment, the drive roller diameter is twice the diameter of the idler roller. The idler roller 38 has a plurality of equally spaced, teeth-like projections 40 which extend a distance from a cylindrical hub 39 (FIG.

4) which is at least sufficient to ensure that the recording liquid forming the wet images 19 will not be able to reach the vicinity of the hub, so that when the projections are rotated and thus step substantially one projection at a time into the wet images on the top side 32 of the recording medium 12, the ink or recording liquid is always spaced from the hub and will not build up thereon. To prevent the recording liquid from wetting the projections 40 and moving by surface tension into the space or troughs between the projections and collecting on the hub, the projections are coated with a hydrophobic material which is not wetted by a water based recording liquid, such as, for example, Teflon ®. Though the idler roller projections have a surface material which is not wetted by the recording liquid, a cleaning roller 37 (FIG. 1) is rotatably mounted for contact with the distal ends of the idler roller projections to ensure that they remain free of recording liquid and other contamination, such as dust and paper fibers. Preferably, the idler roller is formed from such material by injection molding and is entirely out of a non-wetting material. This feature of not being wetted by the recording liquid forming the wet images 19 ensure that the recording liquid is not tracked into non-image or background areas. According to the preferred embodiment, each tooth-like projection will, upon contact with the recording medium, roll a certain amount until the next projection arrives at the recording medium. While the rolling action can cause some movement of the recording liquid if it happens to land near the trail edge of a solid area of the wet image, the length of contact for each projection is minimal when the arc length of rolling contact of the projection is minimized. If the angular pitch between projections is $\theta$, each projection will be in contact with the recording medium for $\theta$ degrees of rotation. For a projection with radius "r", the arc length "s" of rolling contact will be:

$$s = r\theta$$

Figure 5:
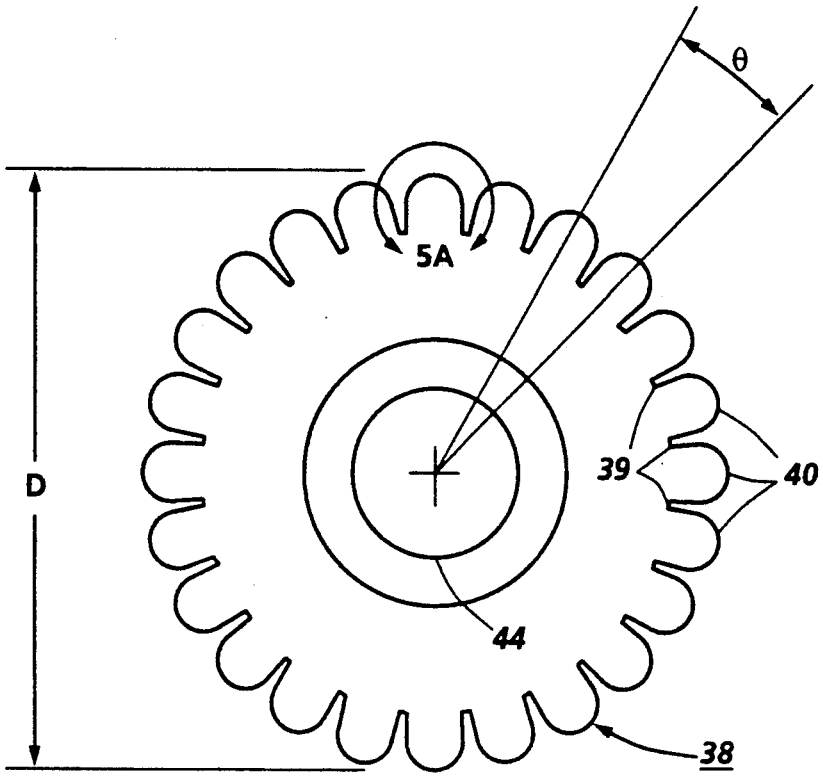
FIG. 5 is an enlarged side view of the toothed idler roller of FIGS. 1 and 3.
Figure 5A:
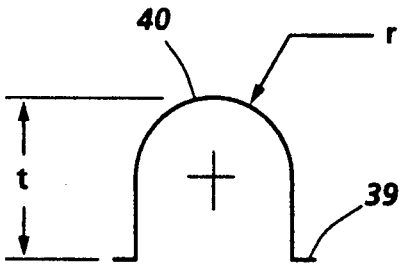
FIG. 5A is an enlarged side view of one tooth of the idler roller of FIG. 5.

FIG. 4 is an enlarged side view of a portion of the toothed idler roller 38, showing that as each tooth-like extension 40 steps into a wet image 19 on the top surface 32 of recording medium 12, the tooth-like extension is long enough to space the recording liquid, which forms the wet images, from the hub 39. FIG. 5 is an enlarged side view of the toothed idler roller of the present invention, and FIG. 5A is an enlarged side view of one tooth of the idler roller in FIG. 5 as indicated by the encircled tooth identified as 5A. In the preferred embodiment shown in FIGS. 4, 5, and 5A, $r=0.5$ mm and $\theta=15°$, so that the length of contact is $s=(0.5\text{ mm})(15°)(\Pi/180°)=0.131$ mm or 0.005 inches. For an idler roller having an overall diameter "D" of 12 mm, the number of projections is 24 and the projection height "t" is about 1.25 mm.

Referring to FIG. 3, the drive means 20 is shown having two spaced drive rollers 36 fixedly mounted on a common drive shaft 42 which is rotated by a driving means, such as an electric motor (not shown), so that the drive rollers are rotated about axis 42A. Two idler rollers 38 are rotatably mounted on either a common shaft 44 or individual shafts, but the individual shafts must be collinear and rotatable about a common axis 44A. The axes of rotation 42A and 44A are parallel to each other, with the distance between the axes being sufficient to allow the projections of the idler roller to contact the surface of the drive rollers. The idler rollers are free to move downwardly under gravity to place a normal force on the drive rollers, so that when a recording medium 12 (shown in dashed line) is moved between the nip 46 formed by the drive and idler rollers, the frictional surface of the drive roller will transport it until the trailing edge of the recording medium is moved from the nip. Optionally, the idler rollers are biased by spring 30 (FIG. 1) to place a positive normal force on the recording medium, thus eliminating the possibility of a stall condition when recording-medium to drive-roller-surface friction forces may be low.

Figure 6:
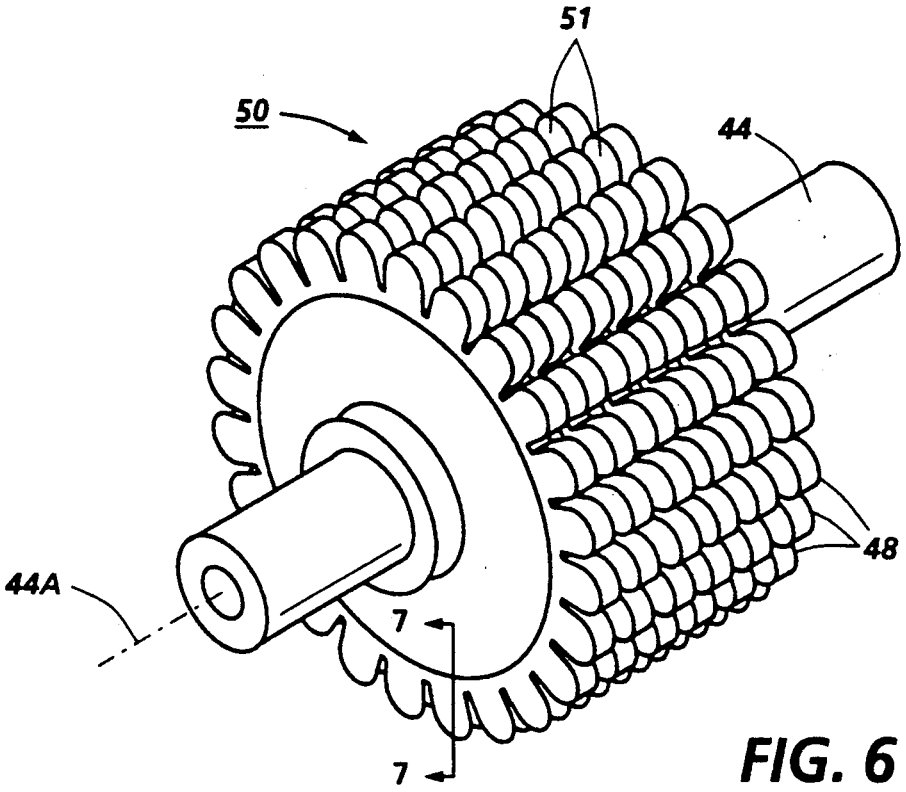
FIG. 6 is an alternate embodiment of the toothed idler roller of the drive means shown in FIG. 3 depicting rows of projections for each tooth.
Figure 7:
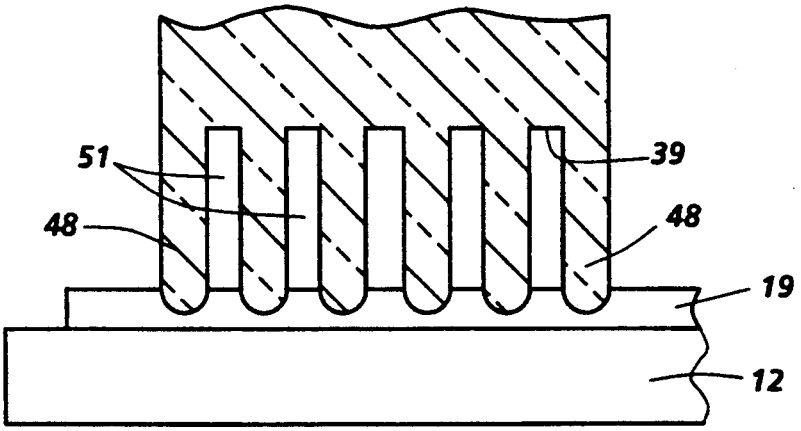
FIG. 7 is a cross-sectional view of one row of projections as viewed along view line 7—7 in FIG. 6.

An alternate embodiment of the present invention is shown in FIGS. 6 and 7, where the elongated projections 40 of the idler roller 38 in FIG. 3 is replaced in the isometric view of an alternate embodiment of the idler roller 50 with a row of individual projections 48, so that the rows of projections resemble an ear of corn, except that each projection stands alone and does not touch each other. Therefore, there are spaces 51 between the projections 48 in each row as well as spaces between each row of projections. This configuration reduces the contact area to minimize the potential for image disturbance. The projections 48 may be cylindrical with hemispherical distal ends or may be produced by cutting parallel, equally spaced circular grooves in the teeth-like projections 40 of the idler roller in FIG. 3. The depth of the grooves are coplaner with the hub 39. FIG. 7 is a cross-sectional view of one row of projections 48 as viewed along view line 7—7 in FIG. 6. In another embodiment, not shown, the elongated projections of FIG. 3 may be arranged in a helical pattern to eliminate chordal movement of the recording liquid during rotation.

It is, therefore, evident that there has been provided, in accordance with the present invention a drive means for transporting a recording medium having wet images on one surface thereof which will not force the recording liquid from the image areas into non-image areas nor track recording liquid onto the background areas. While this drive means has been described in conjunction with various embodiments thereof, it is evident that many alternatives, modifications and variations will be apparent to those skilled in the art. Accordingly, this invention is intended to embrace all such alternatives, modifications and variations as fall within the spirit and broad scope of the appended claims.

I claim:

1. A recording medium drive means in a printer for transporting a recording medium having liquid images on one surface thereof, the images being printed thereon by the printer with a recording liquid, the drive means comprising:

a drive roller having a high friction surface and an axis of rotation, the drive roller being rotatably mounted beneath and tangent to a planar path of movement for a recording medium, the drive roller being oriented to move a recording medium along said path of movement;

means for driving said drive roller;

a toothed idler roller having an axis of rotation and spaced teeth with rounded distal ends extending from a cylindrical hub, the teeth having a predetermined height t from said hub and having a predetermined spacing between said teeth, the distal ends of said teeth having a surface which is not wet by the recording liquid, said idler roller being rotatably mounted above the recording medium planar path of movement with the idler roller axis being parallel to the drive roller axis; and means for urging said idler roller teeth into contact with the drive roller to thereby form a driving nip in which said idler roller teeth apply a force normal to the drive roller surface, so that when said recording medium is moved along said path of movement with an image-free surface in a direction to be contacted and driven by the idler roller, the idler roller teeth place a normal force on the recording medium surface containing liquid images thereon without forcing recording liquid into non-image areas and without damaging the recording medium surface.

2. The recording medium drive means of claim 1, further comprising:

a cleaning roller being rotatably mounted with the cleaning roller contacting the distal ends of the idler roller teeth, so that any recording liquid adhering to the distal ends of the idler roller teeth is removed therefrom.

3. The recording medium drive means of claim 1, wherein the spaced teeth are equally spaced about the cylindrical hub with an angular pitch of $\theta$ degrees; wherein the cylindrical hub has an axis collinear with the axis of rotation of the idler roller and has a predetermined width; and wherein the spaced teeth each have a width about equal to the width of the cylindrical hub.

4. The recording medium drive means of claim 3, wherein the surface of the teeth is hydrophobic, and wherein the recording liquid is water based.

5. The recording medium drive means of claim 4, wherein the hydrophobic surface of the teeth is Teflon ®.

6. The recording medium drive means of claim 4, wherein the idler roller is Teflon ®.

7. The recording medium drive means of claim 1, wherein the means for urging said idler roller into contact with the drive roller is accomplished by force of gravity acting on the idler roller.

8. The recording medium drive means of claim 1, wherein the means for urging said idler roller into contact with the drive roller is by spring bias.

9. The recording medium drive means of claim 1, wherein the distal ends of the spaced teeth have hemispherical cross-sectional areas with radius r, and wherein the predetermined spacing between teeth is an angular pitch $\theta$.

10. The recording medium drive means of claim 9, wherein the distal ends of the teeth have an arcuate length of rolling contact s equal to r $\theta$.

11. The recording medium drive means of claim 10, wherein $r=0.5$ mm and $\theta=15°$; and wherein the toothed idler roller has an overall diameter equal to 12 mm, so that the number of teeth is 24 and height t of the teeth is 1.25 mm.

12. The recording medium drive means of claim 1, wherein each tooth is a row of separate, spaced projections to reduce contact area with the liquid images and thereby minimize the potential for image disturbance.

13. The recording medium drive means of claim 12, wherein each projection in the row of projections is cylindrical with hemispherical distal ends.

14. The recording medium drive means of claim 13, wherein the drive means further comprises:

a cleaning roller being rotatably mounted with the cleaning roller contacting the distal ends of the idler roller teeth, so that any recording liquid adhering to the distal ends of the idler roller teeth is removed therefrom.

15. The recording medium drive means of claim 1, wherein row of separate, spaced projections are formed by cutting equally-spaced, parallel circular grooves of equal depth in the teeth which are perpendicular to the axis of rotation of said idler roller.

* * * * *